US006915601B2

(12) United States Patent
Davis et al.

(10) Patent No.: US 6,915,601 B2
(45) Date of Patent: Jul. 12, 2005

(54) SIZING TAG

(75) Inventors: Kim Davis, Granville, OH (US); Donald Stewart, Columbus, OH (US)

(73) Assignee: Victoria's Secret Stores, Inc., Columbus, OH (US)

( * ) Notice: Subject to any disclaimer, the term of this patent is extended or adjusted under 35 U.S.C. 154(b) by 35 days.

(21) Appl. No.: 10/611,727

(22) Filed: Jul. 1, 2003

(65) Prior Publication Data

US 2005/0000134 A1 Jan. 6, 2005

(51) Int. Cl.[7] ..... G09F 3/10
(52) U.S. Cl. ..... 40/299.01; 40/665; 24/200
(58) Field of Search ..... 40/299.01, 640, 40/665, 312; 24/198, 200, 570, 563; 292/307 A, 325; 206/459.1, 459.5

(56) References Cited

U.S. PATENT DOCUMENTS

| | | | | | |
|---|---|---|---|---|---|
| 137,000 | A | | 3/1873 | Hunt | |
| 231,277 | A | * | 8/1880 | Cohen | 40/665 |
| 292,196 | A | | 1/1884 | Ayer | |
| 616,653 | A | * | 12/1898 | Bowen | 40/665 |
| 1,281,856 | A | | 10/1918 | Kolibas | |
| 1,328,019 | A | * | 1/1920 | Stewart | 40/665 |
| 1,333,102 | A | | 3/1920 | Dietsche | |
| 1,380,472 | A | | 6/1921 | Gilsson | |
| 1,414,599 | A | | 5/1922 | Stockman | |
| 1,574,885 | A | * | 3/1926 | Henne | 427/155 |
| 1,948,615 | A | * | 2/1934 | Clark | 53/436 |
| 1,986,649 | A | | 1/1935 | Steele | |
| 2,054,227 | A | * | 9/1936 | Nichols | 40/665 |
| 2,059,515 | A | | 11/1936 | Freysinger | |
| 2,150,960 | A | * | 3/1939 | Bertel | 414/788.1 |
| 2,286,181 | A | | 6/1942 | Steele | |
| 2,634,484 | A | | 4/1953 | Vaisey et al. | |
| 2,797,462 | A | | 7/1957 | Katzman | |
| 3,112,543 | A | | 12/1963 | Derrickson | |
| 3,395,470 | A | | 8/1968 | Voice | |
| 3,585,743 | A | * | 6/1971 | Jeffers | 40/665 |
| 3,818,897 | A | | 6/1974 | Smith | |
| 4,052,773 | A | | 10/1977 | Nesbitt | |
| 4,536,924 | A | | 8/1985 | Willoughby | |
| 4,670,945 | A | | 6/1987 | Banks | |
| 4,827,796 | A | | 5/1989 | Horian | |
| D313,204 | S | | 12/1990 | Bodt | |
| 5,140,724 | A | | 8/1992 | Crisanti | |
| 5,233,380 | A | | 8/1993 | Marvy | |
| 5,402,592 | A | * | 4/1995 | Caveney et al. | 40/665 |
| 5,426,829 | A | | 6/1995 | Hsiung | |
| 5,503,114 | A | * | 4/1996 | Castagna | 40/665 |
| 5,584,103 | A | | 12/1996 | Slavin | |
| 5,758,443 | A | | 6/1998 | Pedrazzini | |
| 5,970,641 | A | | 10/1999 | Bracken, Jr. | |
| 6,058,639 | A | * | 5/2000 | Tinklenberg et al. | 40/665 |
| 6,182,388 | B1 | | 2/2001 | Patton | |
| 6,226,912 | B1 | * | 5/2001 | Tackett et al. | 40/673 |
| 6,389,605 | B2 | | 5/2002 | Srivastava | |

* cited by examiner

*Primary Examiner*—Gary C. Hoge
(74) *Attorney, Agent, or Firm*—Colucci & Umans; Peter C. Michalos; Angelo Notaro

(57) ABSTRACT

An information displaying arrangement and method for items of soft-goods displaying in a stack, uses a band engaged around each item and spanning an edge of the item, and a tag having a pair of slots with the tag being threaded on the band which extends through the slots. The tag is at the edge of the item, so that the information printed on the tag is visible at the edge even with the item in a stack of such items.

16 Claims, 2 Drawing Sheets

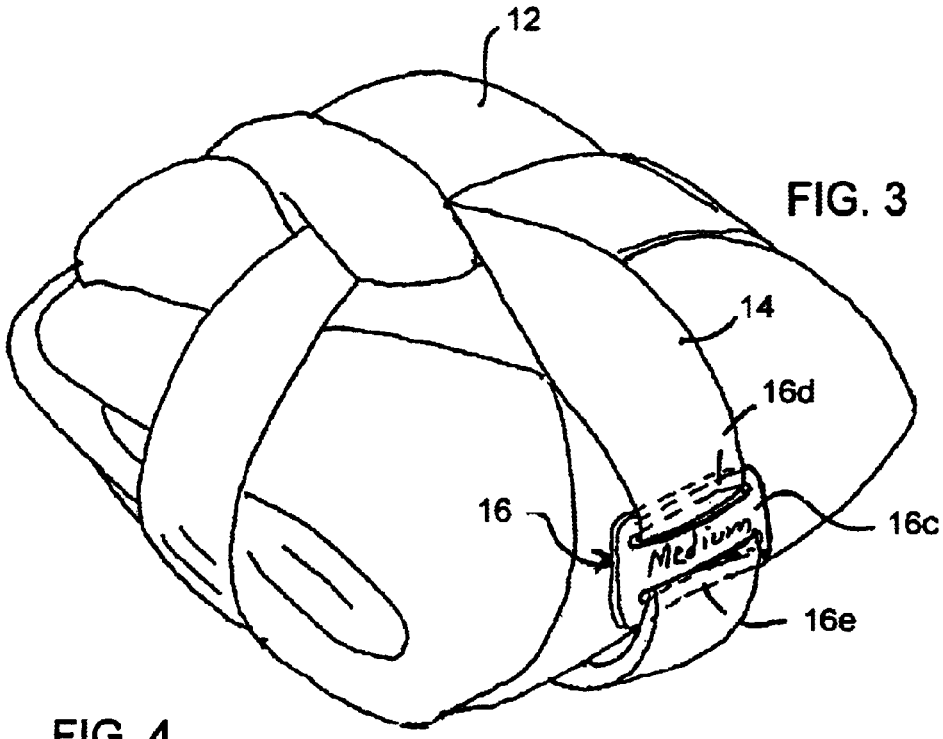
FIG. 3
FIG. 4
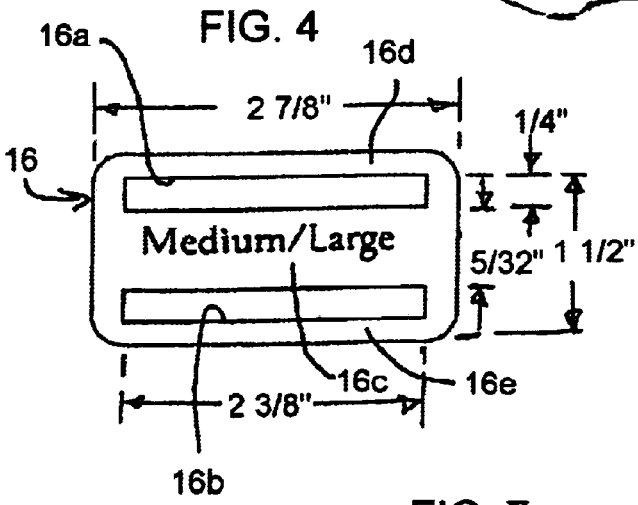
FIG. 5
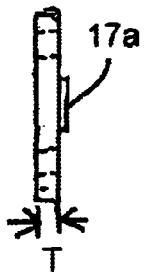
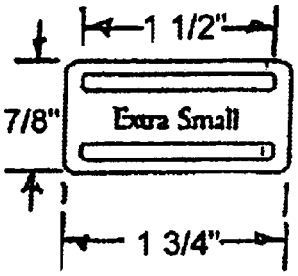
FIG. 6
FIG. 7
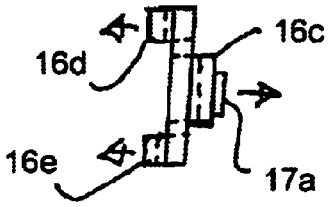
FIG. 8
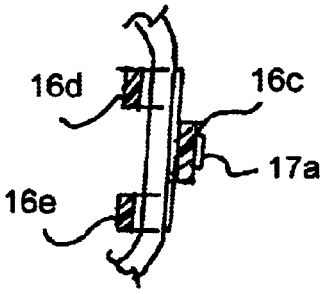

SIZING TAG

FIELD AND BACKGROUND OF THE INVENTION

The present invention relates generally to the field of soft-goods labeling, and in particular to a new and useful sizing tag and method of using the same to label clothing items, towels, sheets or any other soft-goods, that can be displayed in a stack.

Following are U.S. patents that are relevant to the present invention: 137,000 to Hunt; 292,196 to Ayer; 1,281,586 to Kolibas; 1,333,102 to Dietsche; 1,380,472 to Glisson; 1,414,599 to Stockman; 1,986,649 to Steele; 2,059,515 to Freysinger; 2,286,181 to Steele; 2,634,484 to Vaisey et al.; 2,797,462 to Katzman; 3,112,543 to Derrickson; 3,395,470 to Voice; 3,818,897 to Smith; 4,052,773 to Nesbitt; 4,536,924 to Willoughby; 4,670,945 to Banks; 4,827,796 to Horian; 5,140,724 to Crisanti; 5,233,380 to Marvy; 5,426,829 to Hsiung; 5,584,103 to Slavin; 5,758,443 to Pedrazzini; 5,970,641 to Bracken; 6,182,388 to Patton; 6,389,605 to Srivastava; and D313,204 to Bodt.

None of these patents disclose a selectively positioned slidable buckle-like tag, secured to a packaging band, ribbon, belt or strap of a folded article of clothing or other soft-goods, where the tag has two elongated slots and descriptive information about the soft-goods, such as logo and/or size indicia on a central surface between the slots, that is visible even when other similar articles are stacked on top.

U.S. Pat. No. 5,233,380 to Marvy discloses a film holder packaging strap and an identifying label plate with indicia for identifying the type of film in the film holder. A brand name or code for the type of film is provided on the plate.

U.S. Pat. No. 5,584,103 to Slavin discloses a reusable plastic banding strap for securing items in a rolled position. The device further provides a surface for placement of indicia to describe the contents of the secured rolled materials.

U.S. Pat. Nos. 1,986,649 and 2,286,181 to Steele disclose a wrapping band and fastener for securing a folded garment of clothing.

U.S. Pat. No. 137,000 to Hunt discloses a package band and fastener. The package band is paper, leather or fibrous fabric. U.S. Pat. No. 2,797,462 to Katzman discloses a belt buckle upon which is mounted interchangeable, ornamental indicia or letters or insignia. The buckle comprises a base which includes a top portion provided with a bail member for attachment to the end of the belt.

U.S. Pat. No. 1,281,586 to Kolibas discloses a package tie for securing a package, box or the like. Straps are wrapped around the article and are secured together at an intersection by a rivet.

Other patents disclose attachments for labeling clothes. In particular, U.S. Pat. No. 5,970,641 to Bracken discloses a strip of flexible material which has indicia repeatedly printed on an outer surface providing sizing or other information about a foldable article to which the strip is attached via an adhesive rear surface. The strip may be placed on the folded article of clothing in a location that is visible to customers despite other similar articles of clothing being stacked on top.

U.S. Pat. No. 3,395,470 to Voice discloses a garment label used to identify the fabric of a particular garment to which it is attached. The garment label is secured to the garment at a position where an excess of the fabric of the garment is present, such as for example, the bottom of uncuffed men's trousers. An opening in the label allows the excess of fabric to be visible while secured. The excess of the fabric is then cut from the garment, and remains visible through the opening of the label. The label has printed matter on the top and bottom half, relating to the type of garment it is attached to.

The remaining listed patents disclose other buckles and straps, and combinations thereof which are distinguishable from the invention, and they are enclosed for general reference.

SUMMARY OF THE INVENTION

It is an object of the present invention to provide an information displaying arrangement and method for items of soft-goods displayed in a stack, using a band engaged around each item and spanning an edge of the item, and a tag having a pair of slots with the tag being threaded on the band which extends through the slots. The tag is at the edge of the item so that the information printed on the tag is visible at the edge even with the item in a stack of such items.

The band can be an extra ribbon or crossed pair of ribbons wrapping the item and can therefor serve as additional decoration, particularly for items that may be given as a gift. Where the item already has a band, such as a bath robe with waist belt, the existing band or belt is wrapped so that it spans at least one edge surface of the folded item and the tag is provided at that surface.

A still further object of the invention is to provide such a display arrangement and method which uses a flexible synthetic tag that can bend to accommodate even thick bands and one which is clear of translucent (here collectively called translucent) so as not to impair the appearance of the item. The material, e.g. PVC (polyvinylchloride) is also selected to have a high coefficient of friction against the band, so that is does not easily slide away from the edge area.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 3 is a view similar to FIG. 1 of a still further embodiment of the invention;

FIG. 4 is a front elevation of the tag of FIG. 3;

FIG. 5 is side elevation thereof;

FIG. 6 is a front elevation of a tag like that disclosed in of FIG. 2;

FIG. 7 is a side elevation of a tag of the invention illustrating the flexible nature of the material of the tag; and FIG. 8 is a side sectional view of the tag of FIG. 7 with a band extending therein.

DESCRIPTION OF THE PREFERRED EMBODIMENTS

Figure 1:
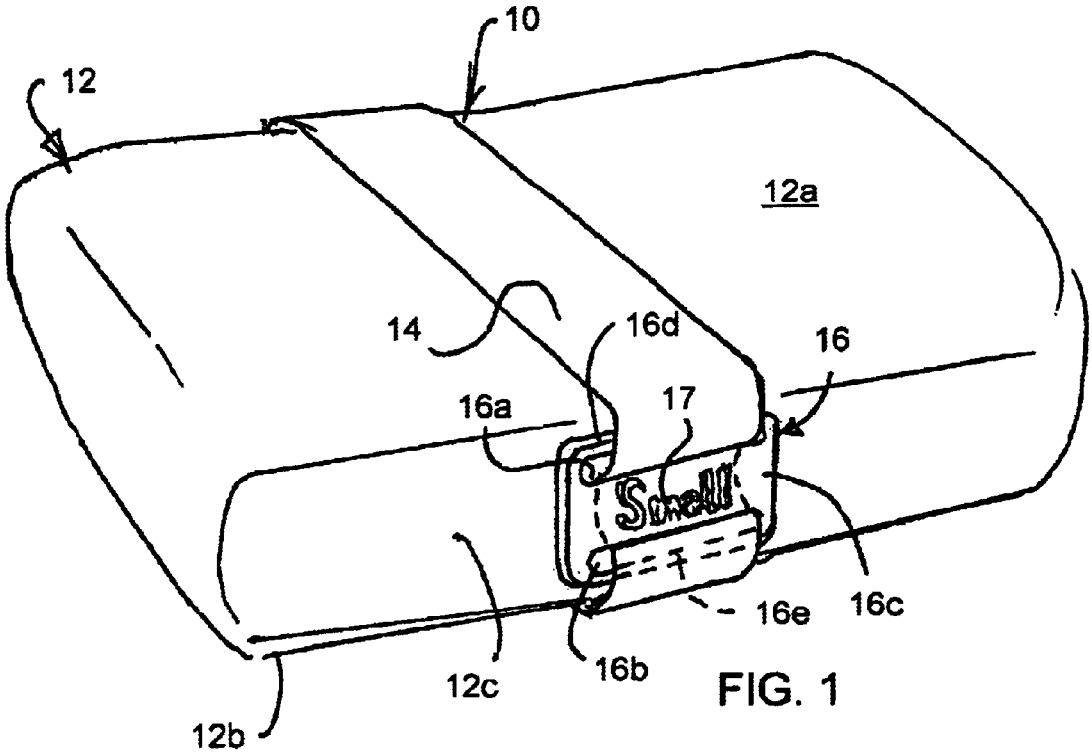
FIG. 1 is a perspective view of an information tag and band for labeling a piece of soft-goods which is to be displayed in a stack of like or different goods.

Referring now to the drawings, in which like reference numerals are used to refer to the same or similar elements, FIG. 1 illustrates an information displaying arrangement 10 for soft-goods 12 that are adapted to be displayed in a stack. Such items can be clothing that is folded or not folded for display such as pants, tops, shirts, pajamas, sweaters, bath robes or any other garment, or other fabric items like towels, sheets, blankets or any other fabric item, or another other soft-goods that are adapted for display in a stack since they have relatively broad upper and lower surfaces 12*a*, 12*b*, and relatively narrow edge surfaces 12*c*.

The arrangement comprises at least one band 14 engaged around the item 12 and spanning at least one of the edge surfaces 12*c* and a self-supporting tag 16 having a pair of slots 16*a* and 16*b* spaced from each other and defining an information carrying portion 16*c* therebetween. A pair of straps 16*d* and 16*e* also extend along each slot.

Figure 2:
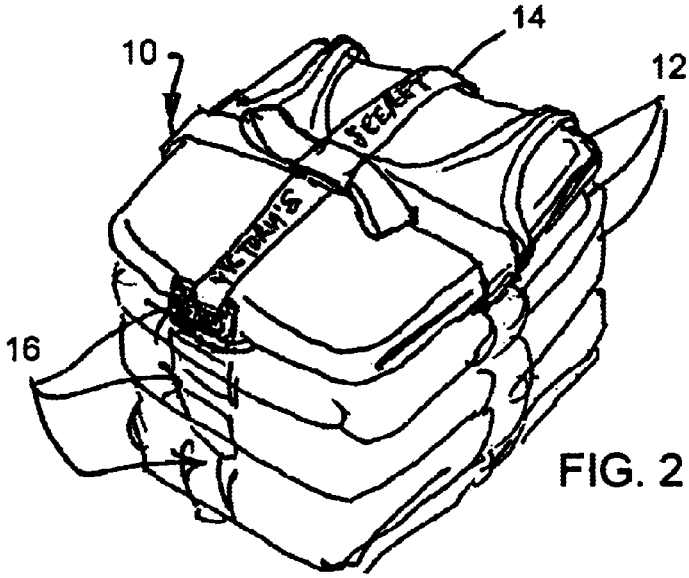
FIG. 2 is a view similar to FIG. 1, of another embodiment of the invention.

The tag is threaded on the band 14 which extends through both of the slots 16*a* and 16*b*, and the tag 16 is positioned at the edge surface 12*c* so that the information carrying portion 16*c* is visible at the edge surface even with the item in a stack as shown in FIG. 2.

Information 17 concerning the item, such as size information (e.g. Small, Medium, Large), a logo or a brand name, or an other type of information is printed or otherwise provided at the information carrying portion 16*c*. As illustrated in FIG. 2, the band may be a crossed ribbon 14 which even carried a brand, e.g. "VICTORIA'S SECRET," printed on it.

Unlike the label strip of U.S. Pat. No. 5,970,641 to Bracken which requires multiple repeats of the same information so as to be sure that the information will be available at the item edge, the present invention provides this information on the well positioned tag 16 which cannot easily slide way from the edge surface since this would require the tag to move on the band, around the corner of the item and onto one of its upper or lower surfaces.

The tag can also advantageously be made of flexible material so that, as shown in FIGS. 3, 7 and 8, at least one, but usually both of the straps 16*d* and 16*e*, and/or the information carrying portion 16*c*, bend to accommodate the band. This is particularly useful for thick bands, e.g. when the band is actually a belt already forming part of the item, such as the bath robe 12 illustrated in FIG. 3 in which the existing belt 14 is crossed over the folded robe to wrap it, and the tag 16 is treaded onto the belt at one edge surface of the folded garment.

The tag 16 is best made of synthetic polymer material which is translucent, that is clear or transparent, or just light-transmitting, and has a high coefficient of friction with respect to the band so that it will not so easily slide alone the band 14. The best material for the clear tag 16 is PVC. The tags may have a smooth surface facing the item and a frosted surface facing away from the item. If both surfaces are smooth the tag is more transparent while the frosted outer surface results in a less clear but rather translucent appearance.

The information 17 is printed on a surface of the information portion 16*c* facing outwardly from the item 12 but this is not essential for a clear material band where the printing can be on the inner surface or even embedded in the material of the tag, but is still visible.

The information can, however, be printed or formed of raised letters 17*a* as best seen in FIGS. 5, 7 and 8, that are raised from the surface of the information carrying portion and therefore can be seen and felt. Since the tags 16 can be cast, cut, punched or molded in any inexpensive and known manner, the letters can like-wise be formed as part of the process.

FIGS. 4 and 6 show that the tag is advantageously rectangular and the slots are straight and parallel to each other. Typical dimensions are illustrated in FIGS. 4 and 5 for larger items such as bath robes as in FIG. 3, and in FIG. 6 for small items such as a pajama set including a folded top and bottom set in FIG. 2.

In FIG. 2, the band 14 is a wrapping ribbon added to the item for displaying the tag and functioning as additional decoration and also functionally to hold the folded set together in a secure fashion. Thus, even if a shopper hastily "thumbs through" the stack of items 12 as illustrated in FIG. 2, the items will not come undone and require refolding.

The band may also include crossing ribbons 14 as in FIG. 2, around the item and transverse to each other to create a gift-wrapped appearance.

The invention is also a method of displaying information concerning items of soft-goods in a stack of items where each item has relatively broad upper and lower surfaces and relatively narrow edge surfaces. The method comprises providing at least one band 14 around each item which spans at least one of the edge surfaces of each item, providing a self-supporting tag 16 having a pair of slots spaced from each other and defining an information carrying portion therebetween and a pair of straps extending along each slot, the tag being threaded on the band which extends through both of the slots, and the tag being positioned at the at least one edge surface so that the information carrying portion is visible at the at least one edge surface, providing information concerning the item at the information carrying portion and displaying the items in a stack with the at least one edge surface of each item that carries the tag being on a common side of the stack.

The term "self-supporting" is meant to define the property of the tag as being relatively firm and structural, while still allowing bending. A method this includes the tag being made of flexible material so that at least one of the straps and the information carrying portion bend to accommodate the band, e.g synthetic polymer material, which also may be is translucent, in particular, PVC.

While a specific embodiment of the invention has been shown and described in detail to illustrate the application of the principles of the invention, it will be understood that the invention may be embodied otherwise without departing from such principles.

What is claimed is:

1. An information displaying arrangement for soft-goods that are adapted to be displayed in a stack, each item of the soft-foods having relatively broad upper and lower surfaces and relatively narrow edge surfaces, the arrangement comprising:

at least one band engaged around the item and spanning at least one of the edge surfaces;

a self-supporting tag having a pair of slots spaced from each other and defining an information carrying portion therebetween and a pair of straps extending along each slot, the tag being threaded on the band which extends through both of the slots, and the tag being positioned at the at least one edge surface so that the information carrying portion is visible at the at least one edge surface, the tag being made of synthetic polymer material which is translucent and has a high coefficient of friction with respect to the band; and information concerning the item at the information carrying portion, the tag being flexible so that at least one of the straps and the information carrying portion bend to accommodate the band.

2. An information displaying arrangement according to claim 1, wherein the tag is made of PVC.

3. An information displaying arrangement according to claim 1, wherein the information is printed on a surface of the information portion facing outwardly from the item.

4. An information displaying arrangement according to claim 3, wherein the information is printed of raised letters that are raised from the surface of the information carrying portion.

5. An information displaying arrangement according to claim 1, wherein the tag is rectangular and the slots and straight and parallel to each other.

6. An information displaying arrangement according to claim 1, wherein the band is a ribbon added to the item for displaying the tag.

7. An information displaying arrangement according to claim 6, including a crossing ribbon around the item and transverse to the first mentioned ribbon forming the band.

8. An information displaying arrangement according to claim 1, wherein the band is a belt that forms part of the item for displaying the tag.

9. An information displaying arrangement according to claim 1, in combination with the item, the item being a folded item for display is a stack of items so that the tag is visible at an edge of the stack.

10. A method of displaying information concerning items of soft-goods in a stack of items, each item having relatively broad upper and lower surfaces and relatively narrow edge surfaces, the method comprising:

providing at least one band around each item which spans at least one of the edge surfaces of each item;

providing a self-supporting tag having a pair of slots spaced from each other and defining an information carrying portion therebetween and a pair of straps extending along each slot, the tag being threaded on the band which extends through both of the slots, and the tag being positioned at the at least one edge surface so that the information carrying portion is visible at the at least one edge surface;

providing information concerning the item at the information carrying portion;

the tag being made of synthetic polymer material which is translucent and flexible so that at least one of the straps and the information carrying portion bend to accommodate the band; and displaying the items in a stack with the at least one edge surface of each item that carries the tag being on a common side of the stack.

11. A method according to claim 10, wherein the tag is made of PVC.

12. The method according to claim 10, wherein the information is printed on a surface of the information portion facing outwardly from the item.

13. The method according to claim 12, wherein the information is printed to be raised letters from the surface of the information portion facing outwardly from the item.

14. The method according to claim 10, wherein the tag is rectangular and the slots and straight and parallel to each other.

15. A method according to claim 10, wherein the band is a ribbon added to the item for displaying the tag.

16. A method according to claim 10, wherein the band is a belt that forms part of the item for displaying the tag.

* * * * *